US005406918A

United States Patent [19]

Joko et al.

[11] Patent Number: 5,406,918

[45] Date of Patent: Apr. 18, 1995

[54] INTERNAL COMBUSTION ENGINE

[75] Inventors: Isao Joko; Toshiaki Kakegawa, both of Hino, Japan

[73] Assignee: Hino Jidosha Kogyo Kabushiki Kaisha, Tokyo, Japan

[21] Appl. No.: 169,075

[22] Filed: Dec. 20, 1993

[30] Foreign Application Priority Data

Aug. 4, 1993 [JP] Japan ..... 5-211050

[51] Int. Cl.[6] ..... F02D 13/04

[52] U.S. Cl. ..... 123/321; 123/569

[58] Field of Search ..... 123/320, 321, 569

[56] References Cited

U.S. PATENT DOCUMENTS

| | | | |
|---|---|---|---|
| 4,722,315 | 2/1988 | Pickel | 123/568 |
| 4,984,554 | 1/1991 | Ariga et al. . | |
| 5,123,397 | 6/1992 | Richeson | 123/568 |
| 5,146,890 | 9/1992 | Gobert et al. | 123/321 |
| 5,203,830 | 4/1993 | Faletti et al. | 123/571 |
| 5,226,401 | 7/1993 | Clarke et al. | 123/569 |

OTHER PUBLICATIONS

Article Titled Development of Auxiliary Engine Braking Device for a Heavy Duty Engine with 4-Valve System, in Jidosha Gijutsu, vol 46, No. 10, 1992 with Abridged Translation.

*Primary Examiner*—Raymond A. Nelli

*Attorney, Agent, or Firm*—Oblon, Spivak, McClelland, Maier & Neustadt

[57] ABSTRACT

In addition to an engine-braking master piston, an exhaust-gas-recirculation master piston is provided to pressurize an oil having been supplied to an oil passage and open an exhaust valve in a suction stroke. A directional control valve selectively switches transmission of hydraulic pressures produced by the engine-braking and exhaust-gas-recirculation master pistons so that the exhaust valve adjacent to a top dead center in a compression stroke is opened to discharge the compressed air. Exhaust gas recirculation can be effected while braking action by a braking force produced in the compression stroke is ensured.

1 Claim, 4 Drawing Sheets

INTERNAL COMBUSTION ENGINE

BACKGROUND OF THE INVENTION

The present invention relates to an internal combustion engine with a compression engine brake, said engine brake being utilized for exhaust gas recirculation.

In a conventional engine brake for an internal combustion engine as shown in FIG. 1, upon engine braking with an exhaust brake valve 10 being closed, a master piston 2 for a cylinder 7 is actuated through a rocker arm by a push rod 1 of another cylinder (not shown) to pressurize an oil having been supplied to an oil passage 5 from a rocker shaft support through solenoid and control valves 3 and 4. Then, the compressed oil urges a slave piston 6 to open an exhaust valve 8 adjacent to a top dead center of the cylinder 7 in a compression stroke and discharge the compressed air through an exhaust port 9, so that no force for pushing a piston in the cylinder 7 generates and a braking force obtained in the compression stroke is effectively utilized with no loss.

The conventional engine brake of this type, which is very effective for engine braking, cannot serve for exhaust gas recirculation and therefore cannot contribute to reduction of $NO_x$ and suppression of white smoke at engine starting. Generally, exhaust gas recirculation is difficult to effect especially in turbo-intercooled engines.

The reason for this is that; in most engine operating conditions, the intake manifold pressure is higher than the exhaust manifold pressure.

A primary object of the present invention is therefore to provide all internal combustion engine which overcomes the above-described problems.

BRIEF SUMMARY OF THE INVENTION

In order to attain the object, in an internal combustion engine wherein upon engine braking, an engine-braking master piston for a cylinder is actuated through a rocker arm by a push rod of another cylinder to pressurize an oil having been supplied to an oil passage so that an exhaust valve adjacent to a top dead center in a compression stroke is opened through a slave piston to discharge the compressed air through an exhaust port, the present invention provides an improvement which comprises an exhaust-gas-recirculation master piston adapted to be actuated through a rocker arm by a push rod of said another cylinder to open the exhaust valve in a suction stroke, thereby pressurizing said oil, and a directional control valve for selectively switching transmission of hydraulic pressures produced by said master pistons to said oil passage.

According to the present invention, therefore, engine braking and exhaust gas recirculation can be selectively effected by such selective switching of the directional control valve.

DETAILED DESCRIPTION OF THE PREFERRED EMBODIMENT

The present invention will become more apparent from the following description of a preferred embodiment thereof taken in conjunction with accompanying drawings.

Figure 1:
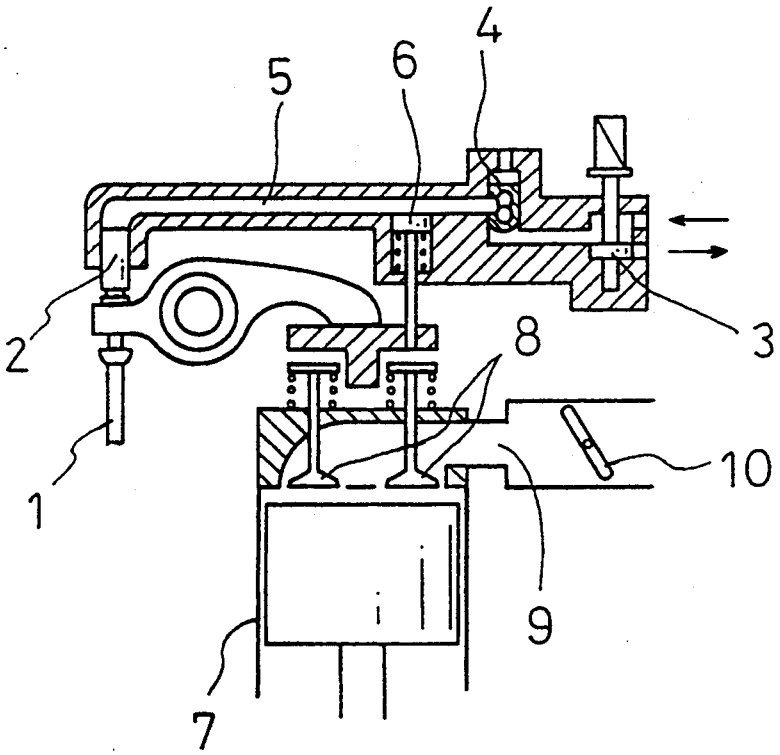
Fig. 1 PRIOR ART
FIG. 1 is a partial sectional view of a conventional engine brake for an internal combustion engine.
Figure 2:
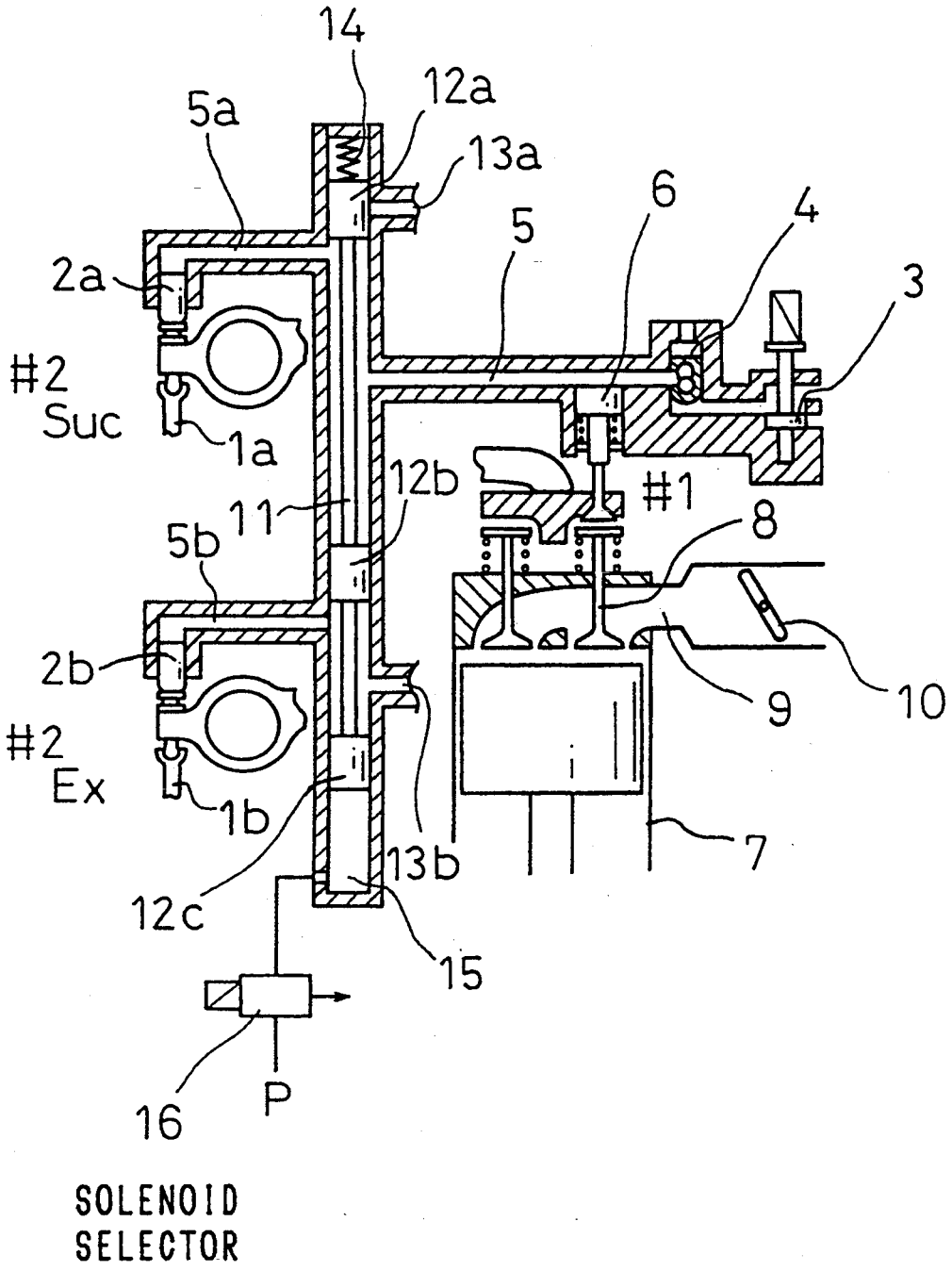
FIG. 2 is a partial sectional view of an embodiment of the present invention.

Referring first to FIG. 2, reference numeral 5 denotes an oil passage to which an oil have been supplied from a rocker shaft bracket (not shown) through solenoid and control valves 3 and 4; 6, a slave piston which opens an exhaust valve 8 depending upon a pressure in the passage 5; 7, a cylinder; and 10, an exhaust brake valve.

Reference numerals 1*a* and 1*b* designate respectively inlet and exhaust push rods of another cylinder (not shown); 2*a*, an engine-braking master piston adapted to be actuated through a rocker arm by the inlet push rod 1*a*; 2*b*, an exhaust-gas-recirculation master piston adapted to be actuated through a rocker arm by the exhaust push rod 1*b*. The master pistons 2*a* and 2*b*, when actuated, pressurize the oil in the passage 5.

Reference numeral 11 denotes a directional control valve which selectively switches transmission of hydraulic pressures produced by the master pistons 2*a* and 2*b* to the passage 5. The valve 11 comprises a spool shaft with a spool 12*a*, 12*b* and 12*c* which selectively open and close the oil passages. As shown in FIG. 2, when the chamber 15 is pressurized, the valve 11 shifts up, and the passages 5*a* and 5 are opened, while the passages 5*b* and 5 are closed. When the chamber 15 is depressurized, the valve 11 shifts down owing to the spring force, and the passages 5*a* and 5 are closed, while the passages 5*b* and 5 are opened.

A switching mechanism for the valve 11 comprises a spring 14 loaded at a top of the valve 11, a chamber 15 at a bottom of the valve 11 and a solenoid selector 16 through which the chamber 15 is connected with a pressure source. Switching of the selector 16 causes the spool shaft to be axially displaced for selective opening and closing of the passages 5*a* and 5*b*. Reference numeral 13*a* and 13*b* designate discharge passages.

Figure 3:
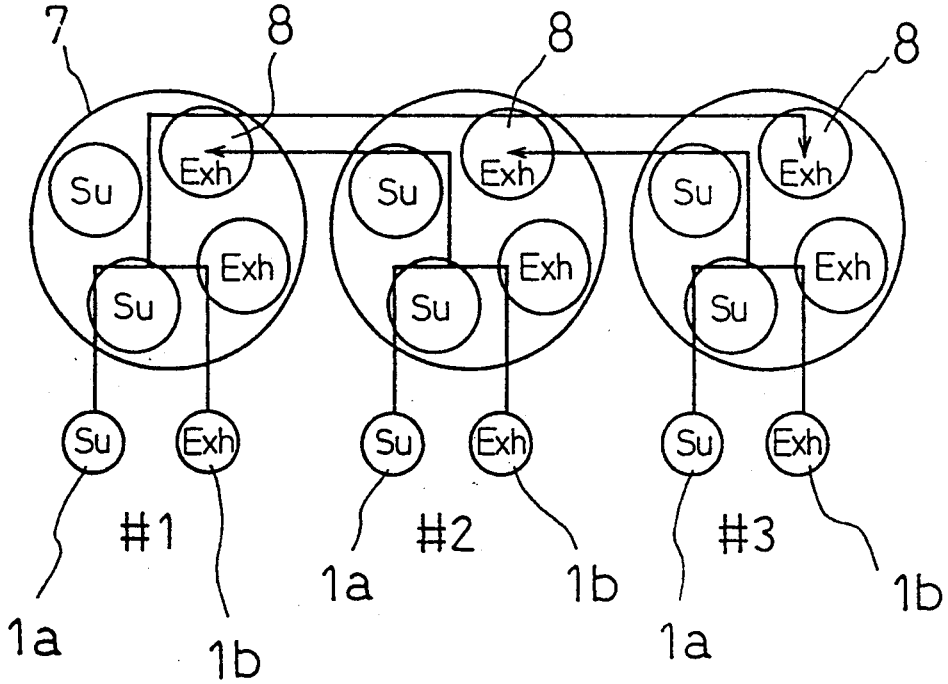
FIG. 3 is a view used to explain application of the present invention to a multi-cylinder internal combustion engine.

FIG. 3 exemplarily shows application of the invention to an in-line 6-cylindered engine where the exhaust valves 8 of the first, second and third cylinders #1, #2 and #3 (7) are controlled by the inlet and exhaust push rods 1*a* and 1*b* of the second, third and first cylinders #2, #3 and #1, respectively.

Next, referring to FIGS. 2 and 3, the mode of operation will be described when the exhaust valve 8 of the first cylinder #1 (7) is controlled by the push rods 1*a* and 1*b* of the second cylinder #2. Upon engine braking, the valve 11 is so switched that the passage 5*b* contiguous to the exhaust-gas-recirculation master piston 2*b* is closed while the passage 5*a* contiguous to the engine-braking master piston 2*a* is connected with the passage 5.

Then, the master piston 2*a* is actuated by the push rod 1*a* of the second cylinder #2 in a suction stroke so that the oil having been supplied to the passage 5 through the valves 3 and 4 from a rocker shaft bracket is pressurized. Due to the hydraulic pressure thus produced, the exhaust valve 8 of the cylinder 7 (the first cylinder #1) in an expansion stroke is opened through the slave piston 6 so that the compressed air is discharged through the exhaust port 9. As a result, no force for pushing down the piston in the cylinder 7 generates and a braking force is effectively utilized with no loss.

For exhaust gas recirculation (EGR), the valve 11 is so switched that the passage 5*a* contiguous to the engine-braking master piston 2*a* is closed while the passage 5*b* contiguous to the exhaust-gas-recirculation master piston 2*b* is connected with the passage 5.

In this case, the exhaust push rod 1*b* of the second cylinder #2 in an exhaust stroke actuates the exhaust-gas-recirculation master piston 2*b* so that the oil having been supplied to the passage 5 from the rocker shaft bracket through the valves 3 and 4 is pressurized. Due to the hydraulic pressure thus produced, the exhaust valve 8 of the cylinder 7 (#1) is opened at the end of the suction stroke of the cylinder 7. Then, an exhaust manifold pressure becomes higher owing to the exhaust stroke of the second cylinder #2 so that part of the exhaust gases from the second cylinder #2 flow back to the cylinder 7 (#1) due to the pressure difference. Thus, the exhaust gas recirculation (EGR) is effected to reduce $NO_x$ and suppress white smoke at engine starting. Such exhaust gas recirculation system is effective for turbo-intercooled engines in which exhaust manifold pressure pulsation owing to exhaust strokes of each cylinders is high.

Figure 4:
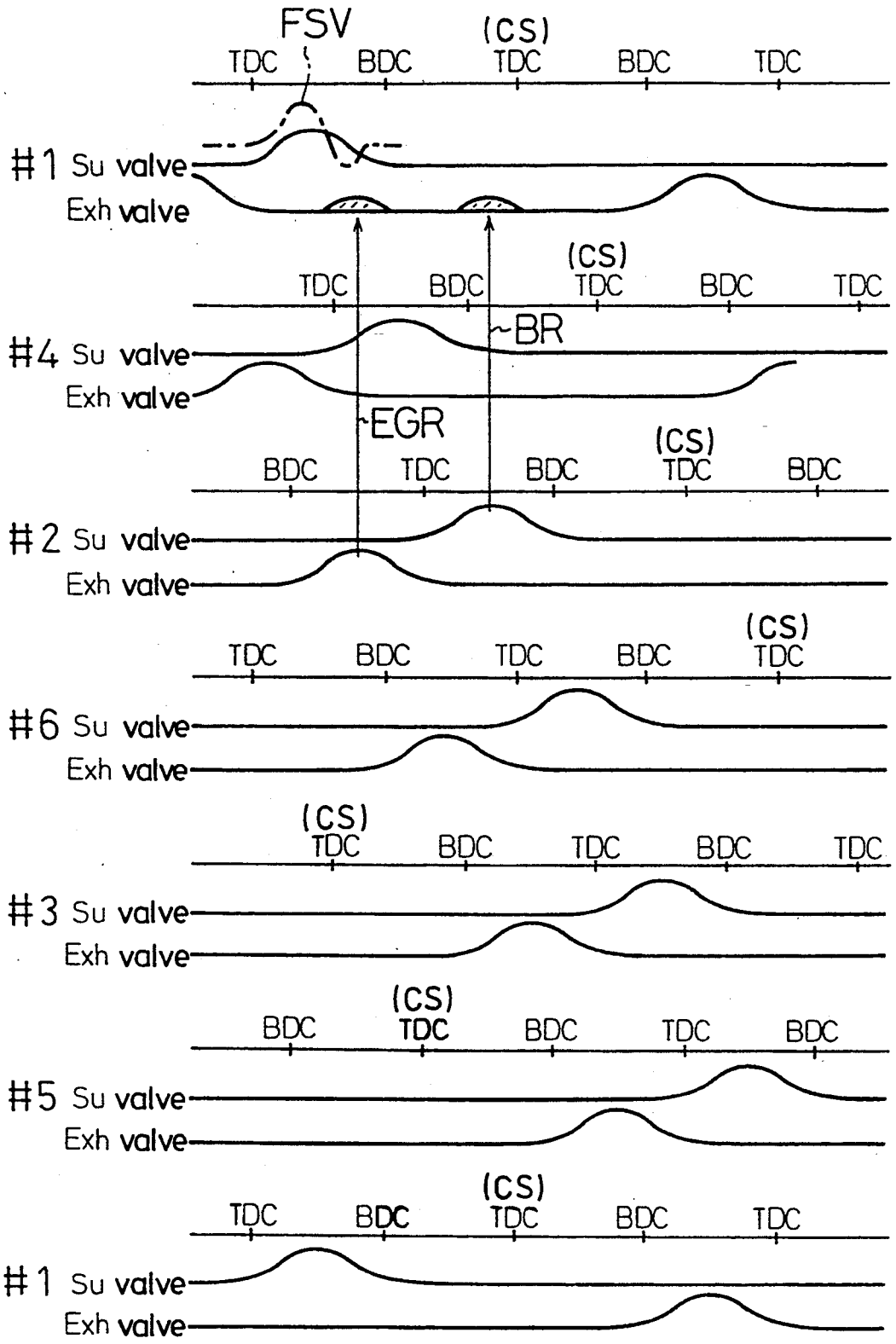
FIG. 4 is a view used to explain the mode of operation of the present invention.

Next referring to FIG. 4, the mode of operation of an in-line 6-cylindered engine to which the present invention is applied will be described. It is assumed that the firing order is #1-#4-#2-#6-#3-#5. The exhaust valve of the first cylinder #1 is controlled by the exhaust push rod of the second cylinder #2 and is opened for exhaust gas recirculation (EGR) when the piston of the first cylinder #1 approaches the bottom dead center (BDC). The exhaust valve of the first cylinder #1 is opened by the inlet push rod of the second cylinder #2 when the piston of the first cylinder #1 approaches the top dead center (TDC) in the compression stroke (CS) of the first cylinder #1 so that the compressed air is discharged and no force for pushing down the piston in the cylinder generates, whereby engine braking (EB) is applied.

As described above, in an internal combustion engine with an engine brake, the present invention provides a directional control valve for selectively switching transmission of hydraulic pressures produced by engine-braking and exhaust-gas-recirculation master pistons to an oil passage. As a result, advantageously, $NO_x$ emission is reduced and white smoke at engine starting is suppressed.

What is claimed is:

1. In an internal combustion engine wherein upon engine braking, an engine-braking master piston for a cylinder is actuated through a rocker arm by a push rod of another cylinder to pressurize an oil having been supplied to an oil passage so that an exhaust valve adjacent to a top dead center in a compression stroke is opened through a slave piston to discharge compressed air through an exhaust port, an improvement which comprises an exhaust-gas-recirculation master piston adapted to be actuated through a rocker arm by a push rod of said another cylinder to open the exhaust valve in a suction stroke, thereby pressurizing said oil, and a directional control valve for selectively switching transmission of hydraulic pressures produced by said master pistons to said oil passage.

* * * * *